US005212845A

United States Patent [19]

Corbiere

[11] Patent Number: 5,212,845

[45] Date of Patent: May 25, 1993

[54] PROCESS FOR THE WARP PRINTING OF A DESIGN ONTO A CLOTH AND APPARATUS FOR CARRYING OUT THIS PROCESS

[75] Inventor: Claude Corbiere, la Tour de Salvagny, France

[73] Assignee: Corbiere & Teintureries de la Turdine, France

[21] Appl. No.: 704,276

[22] Filed: May 22, 1991

[30] Foreign Application Priority Data

May 29, 1990 [FR] France ..... 90 06896

[51] Int. Cl.[5] ..... D06B 1/10

[52] U.S. Cl. ..... 8/149.1; 8/151

[58] Field of Search ..... 68/50, 56; 8/151, 149.1, 8/470, 471; 100/172, 156, 53, 45; 156/359

[56] References Cited

U.S. PATENT DOCUMENTS

| | | | |
|---|---|---|---|
| 3,692,611 | 9/1972 | Kuhnle | 156/358 |
| 3,925,139 | 12/1975 | Simmons | 156/358 |
| 3,994,146 | 11/1976 | Murase | 68/56 |
| 4,086,112 | 4/1978 | Porter | 8/471 |
| 4,089,728 | 5/1978 | Teed | 156/352 |
| 4,338,282 | 7/1982 | Motooka et al. | 68/50 Y |
| 4,357,189 | 11/1982 | Buckwalter et al. | 8/472 X |
| 4,923,848 | 5/1990 | Akada et al. | 8/471 |

FOREIGN PATENT DOCUMENTS

| | | |
|---|---|---|
| 2360881 | 6/1972 | Fed. Rep. of Germany . |
| 2254950 | 11/1975 | France . |
| 5375 | 5/1976 | Switzerland . |
| 1403887 | 8/1975 | United Kingdom . |
| 1466082 | 3/1977 | United Kingdom . |
| 1528411 | 10/1978 | United Kingdom . |

*Primary Examiner*—Frankie L. Stinson
*Attorney, Agent, or Firm*—Wall and Roehrig

[57] ABSTRACT

A method and apparatus are provided for transfer printing a design on warp yarns in a warp and weft fabric by applying a roll of transfer paper carrying a dye design to a moving web of warp yarns. The speed of the web and paper are controlled and heat is applied to transfer the design to the warp yarns. The paper and completed cloth are then rewound.

6 Claims, 2 Drawing Sheets

PROCESS FOR THE WARP PRINTING OF A DESIGN ONTO A CLOTH AND APPARATUS FOR CARRYING OUT THIS PROCESS

The invention relates to a new process for the warp printing of a design onto the warp of a cloth during formation, especially a warp and weft fabric. It also relates to an apparatus for carrying out this process.

BACKGROUND OF THE INVENTION

The technique of warp printing is well known. There is therefore no need to describe it in detail here. This technique is reserved essentially for luxury fabrics.

For some years now these warp-printed fabrics have been obtained by means of the transfer-printing technique (see, for example, the documents FR-A-2,254,950 and 2,296,727). This technique gives excellent results, but is economically viable only for series of considerable length. Moreover, above all, if the warp to which the transfer design is applied has a defect of any kind, such as, for example, a missing thread, the fabric thus printed incorporates this defect which then becomes irreparable. As a result of this, the warp has to be inspected beforehand and the weaving checked very carefully, and this increases the cost of these fabrics in proportion.

The document CH-D-53/75 (corresponding to the document GB-A-1,528,411) suggested using this transfer-printing technique on carpets by carrying out the transfer phase on the lap of yarns intended to constitute the pile or plush loops, and then winding the lap thus printed with the transfer paper onto a beam which is subsequently placed at the head of the tufting machine. For this purpose, first of all, the design to be transferred onto the yarns must possess, in the longitudinal direction of the yarns, an elongation in relation to the design to be obtained on the carpet in order to compensate the shrinkage; the lap thus printed must thereafter be transferred onto the tufting loom, and consequently this technique has the same disadvantages as that described above.

The document BE-A-755,182 suggested the wet printing of a design on a continuously advancing lap of warp yarns on a weaving loom between the beam and the shed formation point. This technique requires complex and bulky installations which are underused because the output is limited by the production speed of the weaving loom which, as is known, is at least one thousand times lower than that of the printing installation. This is doubtless why this technique has not become more widespread.

SUMMARY OF THE INVENTION

The invention overcomes these disadvantages. It is aimed at a warp-printing technique which is less costly and easier to put into practice and in which any defect can be corrected at any moment, without affecting the commercial value of the rest of the article already printed and, finally, which is suitable for the production of small series to order.

This process for the warp printing of a design onto a cloth, in which a lap of warp yarns, wound onto a beam of a loom for producing warp cloth by inserting a weft or binding yarn into the lap of warp yarns, travels continuously from this beam as far as the insertion or binding member, said loom comprising an apparatus for controlling the continuous advance of the lap of warp yarns and the insertion or binding member, is characterized in that it involves:

between the exit of the beam, but before the insertion or binding member, bringing into the vicinity of the lap of warp yarns a transfer paper carrying a dye design capable of being transferred onto the yarns under the effect of heat;

then, causing this transfer paper to travel in a speed ratio with the speed of advance of the lap of warp yarns;

then, still continuously, pressing this traveling transfer paper permanently against the lap of warp yarns likewise traveling in this ratio with the paper, care being taken to direct the sheet of transfer paper carrying the design towards the lap of warp yarns, and simultaneously transferring this design onto the yarns under the continuous effect of this pressure and of dry heat;

and finally, separately receiving the printed cloth obtained after insertion and the transfer paper, the design of which has been transferred at least partially onto the lap of warp yarns.

In other words, the invention involves carrying out the warp-printing technique by means of the transfer technique, both known for a very long time, on the weaving loom itself, and no longer on the warp before this is placed on the weaving, knitting, tufting or suchlike loom, and without previously having to deform the design in the longitudinal direction. This operation is therefore carried out at low cost, the more so because normal designs (ratio of one) are used, and at greatly differing and slow speeds, thereby making it possible to check the printed cloth easily during the actual production. This transposition onto the weaving loom was not an obvious choice. Proof of this is that the transfer-printing technique has been known for a very long time. Integration on a weaving loom represents a break with conventional techniques, the more so because the printing speed is reduced considerably (this running counter to productivity); in contrast, however, this break makes it possible successfully to solve a problem which has existed for a long time and which there were no known means of overcoming in economic terms.

In the description and the claims, the term "loom" or "warp loom" embraces both weaving looms themselves, that is to say warp and weft looms, and warp looms of the run-proof type (Raschel, Malimo or the like), for plush loops or suchlike, that is to say all apparatuses for producing cloths from yarn warps.

Likewise, by "dye design" is meant not only a design obtained from one or more dyes, but also a plain print.

Advantageously, in practice:

the dye design is deposited on at least one lap of warp yarns just upline of the frames of the weaving loom, that is to say between the beam and the said frames, and preferably in the vicinity of the shed formation point;

the speed of advance of the transfer paper carrying the design is synchronized exactly and is equal to the speed of advance of the warp (with the exception of the shrinkage);

the ratio of these two speeds is between 0.1 and two (2), thereby making it possible to use up the design of the paper, which had scarcely been a preoccupation until then; if the ratio is one (1), with the exception of the shrinkage, the design is faithfully reproduced; in contrast, the more this ratio decreases, that is to say the more the speed of the warp exceeds that of the paper (a ratio smaller than 1), the more the paper supporting the dye design is used up, thus resulting in an appreciable saving and a better protection of the environment; on a warp and weft weaving loom, in practice this ratio is between 0.2 and 1; it could be greater than one (1), but this results in excessive and wasteful consumption of paper and therefore of dyes; it was seen that, for a pile or plush-loop fabric, good results are obtained with a ratio of 0.2 and 0.3; these same ratios can be used with a Raschel loom;

the transfer paper is driven positively by a set of pinions, chains and lap rollers controlled by the general control shaft of the loom;

during operation, the heating pad is pressed constantly against the warp yarns just upline of the normal opening point of the warp and is raised automatically and spontaneously whenever the loom stops.

In a shedless loom, the heating pad is placed as near as possible to the entry of the particular warp into the mechanisms.

It goes without saying that the warp yarns must for an essential part be of a material receptive to transfer dyes, that is to say to transferable dyes. These yarns can, for example, be of polyester, polyamide, triacetate, acrylic or even silk or cotton.

The invention also relates to an apparatus for carrying out this process on a warp and weft weaving loom, comprising:

a beam containing a lap of warp yarns, a guide roller on which the traveling lap of warp yarns is spread, a member for inserting a weft or binding yarn into the lap of warp yarns, a general control of the advance of the lap, of the insertion member and of the winding of the cloth formed, characterized in that it comprises in the vicinity of the guide roller:

a first means for delivering a sheet of transfer paper carrying a dye design;

a second means for receiving this sheet;

a heating pad of regulated temperature arranged between these two means and intended for pressing the transfer sheet permanently over the entire width of the traveling lap of warp yarns;

an assembly for ensuring the synchronism of the first and of the second means with the general control of the loom.

Advantageously, in practice:

the first and second delivery and winding means consist of a pair of parallel driving rollers;

the heating pad is arranged between two guide rollers defining a plane coinciding with the plane of the traveling lap of warp yarns;

the heating pad possesses jacks intended, while the loom is in operation, for pressing it onto the traveling lap of warp yarns and springs intended for moving this pad away from the lap immediately, as soon as the loom stops.

BRIEF DESCRIPTION OF THE DRAWINGS

How the invention can be put into practice and the advantages stemming from it will emerge more clearly from the following exemplary embodiments with reference to the accompanying figures.

DETAILED DESCRIPTION OF THE PREFERRED EMBODIMENT

Figure 1:
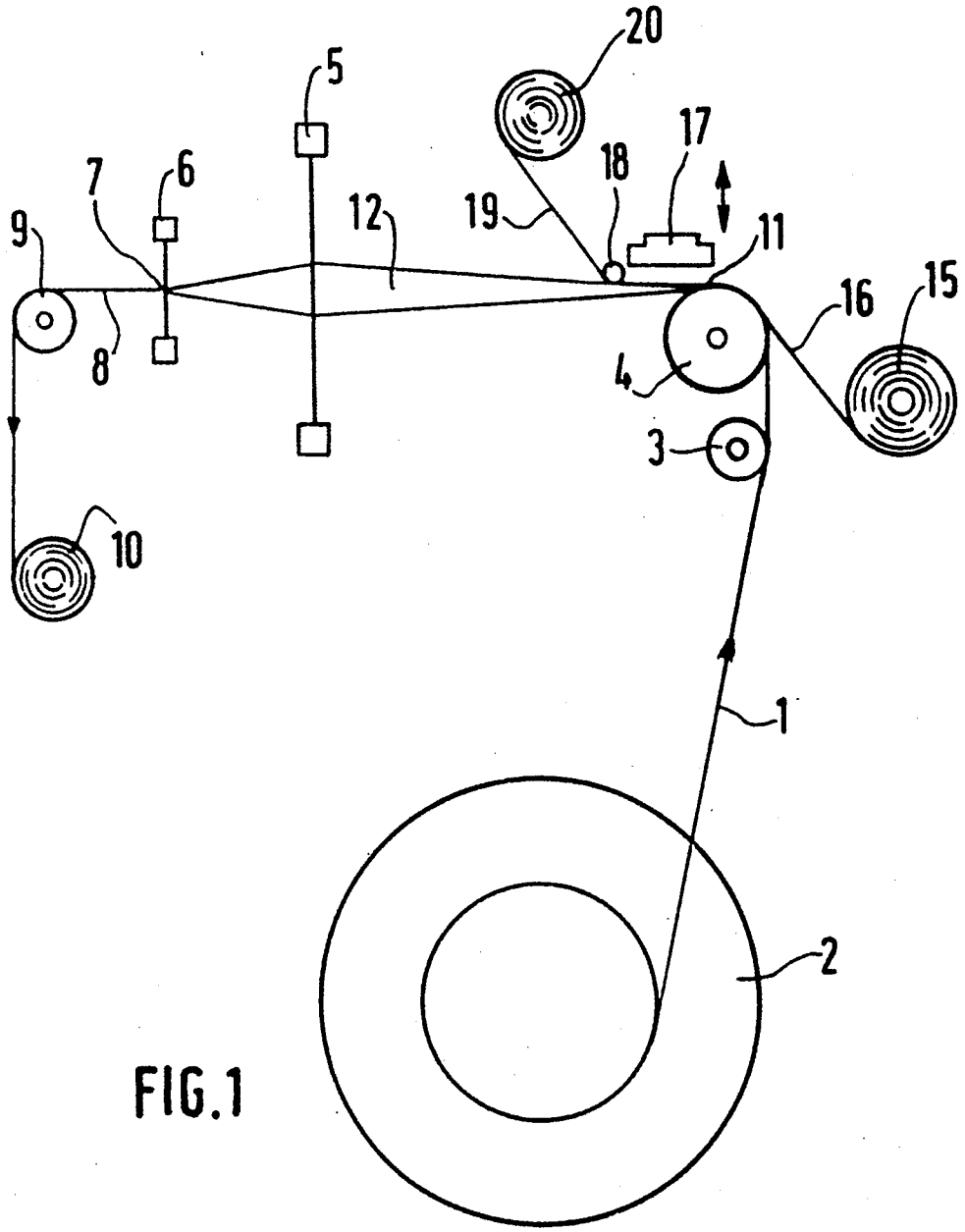
FIG. 1 is a concise diagrammatic representation of a general embodiment of the invention.

Referring to FIG. 1, a lap of warp yarns (1) is unwound in a known way from its beam (2), at the same time passing over a set of guide rollers (3) and (4) respectively. In a known way, the warp enters frames, designated by the reference (5), and then the opening comb (6) which forms the make-up point (7). The formed fabric (8) subsequently passes over a guide roller (9) in order to be wound onto a magazine roller (10).

The reference (11) denotes the point of formation of the shed (12).

A reel (15) of transfer paper (16) carrying a suitable design is brought into contact with the warp (1) by pressing against the guide roller (4). Just next to the formation point (11) of the shed (12) down the line, a heating pad (17) capable of being driven in an up- and down- movement in the direction indicated by the arrow fixes the dye onto the slowly advancing warp (1) under heat. A guide bar (18) makes it possible to recover the spent transfer paper (19) on a roller (20) synchronized with the advance of the loom.

In practice, in this embodiment, the actual opening point of the warp is transferred to (18).

As illustrated, the heating pad (17) is arranged in the vicinity of the guide roller (4) just upline of the formation point (11) of the shed. During operation, this pad (17) is just in contact with the yarn lap (12). This heating pad (17), for example made of anodized aluminum, is heated electrically and is regulated by means of a suitable cabinet at between 150° and 220° C. with an accuracy of two degrees more or less. A raising system (not shown) makes it possible to move the pad (17) away immediately whenever the loom stops, thereby making it possible then to take action on the yarns of the shed (12).

It will easily be appreciated that, when a yarn is missing in the shed (12) or has a defect, it is sufficient to stop the loom, as is customary. The pad (17) immediately moves away. The repair is carried out. When the loom is put into operation again, the pad (17) redescends automatically. Any other defective formation appearing on the make-up between (7) and (9) can thus be corrected instantly in the same way.

In a first preferred embodiment, the winding speed of the paper (19) roller (20) is equal to the speed of advance of the lap of warp yarns (1), with the exception of the shrinkage. The design is thus transferred exactly in a ratio of one to one. Moreover, since the transfer takes place in the vicinity of the shed formation point, because of the continuous movement of the yarns a slight fuzzy effect highly sought after for these luxury fabrics is obtained.

In another embodiment, the winding speed of the roller (20) is synchronized to a fifth of the speed of advance of the lap (1). A perfectly controlled original mottled shaded effect highly sought after at the present time is thereby obtained in an economical and expedient way. Furthermore, the dyes of the transfer paper (16) have thereby been used up completely, thus avoiding or mitigating the pollution problems which this transfer-printing technique presents.

In another embodiment, the fabric (8) is a pile or plush-loop fabric. In the present technique of deferred transfer (see CH-D-53/85 mentioned in the introduction), to print designs onto the warps of loops of these fabrics it is necessary to deform the design in the shrinkage ratio. In the invention, it is sufficient to employ a normal design and to adjust the traveling speed of the paper (19) in relation to the shrinkage. This produces better results and an appreciable saving in terms of both the creation of the design and the execution. In addition, by acting on the speed ratios and the settings of the loom, it is possible to change the design printed on the loops and obtain unexpected original effects, such as mottled, shaded, etc., this not being possible with the technique described in the introduction. The length of the designs can also be changed according to choice.

In another version, the lap of warp yarns (1) can consist of contractable yarns, for example foam-textured yarns. This ensures a fixing of this yarn as a result of the hot-transfer operation (17), thereby making it possible to obtain new and original characteristics and effects.

In one version, the process according to the invention can be carried out on a warp knitting loom. It is sufficient to apply the transfer paper to at least one of the laps of warp yarns in order to obtain a suitable print.

Figure 2:
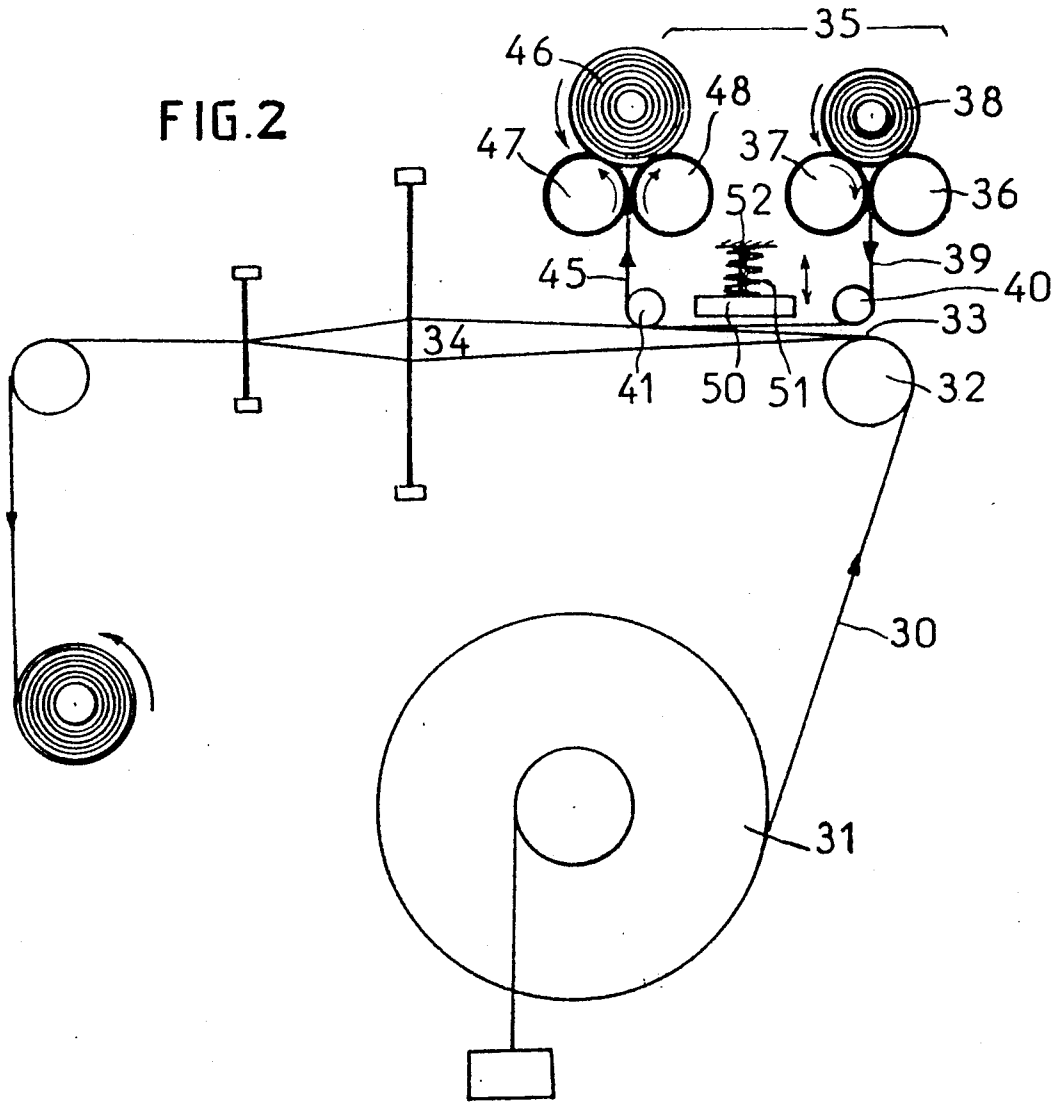
FIG. 2 shows a particular embodiment in a detailed sectional view.

In a practical embodiment illustrated in FIG. 2, the lap of warp yarns (30) is unwound from the beam (31) and passes over a guide roller (32), where the formation point (33) of the shed, designated by the reference (34), is located.

The characteristic transfer assembly, designated by the general reference (35), comprises a first pair of two rollers, namely an idling roller (36) and a driving roller (37), on which the reel (38) of virgin transfer paper (39) is placed. This paper (39), design facing the yarns (30), passes over a first guide roller (40) located in the vicinity of (33) and then over a second guide roller (41), in such a way that the path (40, 41) is substantially horizontal and parallel to the warp (34). The spent paper (45) reascends in order to be received on the reel (46) driven by the pair of driving rollers (47–48). Most generally, the driving rollers (37, 47 and 48) are driven at the same speed and, by means of an assembly of pinions and of chains which is connected to the control shaft of the loom, at the same speed as the speed of advance of the warp (30).

To make it easier to understand the figure and to avoid overloading it, the distance between 33 and 40 has been exaggerated, whereas, in practice, it is reduced to a minimum.

A profiled heating pad (50) similar to (17) keeps the transfer paper (39) permanently pressed against the lap of warp yarns during operation by means of a spring (51) guided on a rod (52). A jack (not shown) parallel to the spring (51) makes it possible to move the heating pad (50) away immediately when the loom stops.

Advantageously, the guide rollers (40) and (41) are each mounted on an arm of adjustable position, thereby making it possible to vary both the distance between (40) and (41) and the pressure of the transfer paper on the lap of warp yarns.

The process according to the invention has many advantages. The following may be mentioned:

a modest investment, since it is sufficient to add a single pad of regulated temperature and a synchronized connection to the conventional drive member of the loom in order to obtain an integrated assembly;

the omission of the separate warp-printing step necessary hitherto and of what follows it, thus resulting in a reduced cost, increased safety and a higher accuracy of the results obtained;

the possibility of using normal transfer papers of current usage, not deformed in the longitudinal direction as in the technique described in the document CH-D-53/75 mentioned in the introduction;

flexibility, since it is very easy to change the transfer paper, hence the possibility of producing small series in the selected order and at any moment; whereas in the prior technique of deferred printing the order in which weaving takes place is fixed counter to the order fixed for the printing;

the possibility of checking the finished cloth virtually instantaneously, hence the possibility of changing the operating conditions quickly;

a good control of the quality of the warp prints thus produced;

the possibility of correcting at any moment the defects attributable to the yarns and to the weaving;

and finally, as a result of the new possibility of acting on the warp and paper speed ratios, the possibility of obtaining original effects, including the reproducible and high-ratio shadings sought after at the present time.

I claim:

1. A process for warp printing a design onto a cloth, wherein a lap of parallel warp yarns is wound onto a beam of a loom for producing cloth by inserting a weft yarn at an insertion point into the lap of warp yarns, said warp yarns continuously travelling from the beam as far as the insertion point, said loom comprising a means for controlling the continuous travel of the warp yarns and the inserting of the weft yarn, said process comprising the steps of;

1) bringing a transfer paper, carrying a dye design capable of being transferred onto said lap of warp yarns when said transfer paper is heated, in proximity with said lap of warp yarns at a position between said beam and said insertion point;

2) causing said transfer paper to travel in a speed ratio with respect to the travel speed of said lap of warp yarns;

3) heating while simultaneously pressing the travelling transfer paper continuously against said lap of warp yarns, while said lap of warp yarns and said transfer paper are travelling in a speed ratio and in proximity to one another, care being taken to direct the travelling transfer paper carrying the dye design towards the lap of warp yarns, while simultaneously transferring said dye design from said transfer paper onto said warp yarns by virtue of said continuous pressure and of dry heat; and 4) receiving separately;

printed cloth obtained by insertion of weft into said warp yarns; and said transfer paper, having had at least some of the dye design therefrom transferred onto the lap of warp yarns.

2. The process as claimed in claim 1 wherein the speed ratio of the transfer paper to the lap of warp yarns is 1:1.

3. The process as claimed in claim 1 wherein the speed ratio of the transfer paper to the lap of warp yarns is between 0.1:1 and 2:1.

4. The process as claimed in claim 1, wherein speed ratio of the transfer paper to the lap of warp yarns is between 1:1 except for a shrinkage factor.

5. The process as claimed in claim 1 wherein the speed ratio of the transfer paper to the lap of warp yarns is approximately 0.2:1.

6. The process as claimed in claim 1, wherein the printed cloth is a warp and weft fabric, and wherein, during operation, a heating pad for application of said dry heat is pressed continuously against the transfer paper which is lying against the lap of warp yarns, immediately before said lap of warp yarns reaches an opening point prior to the insertion point, and wherein said heating pad is raised automatically whenever the loom stops.

* * * * *